US005417196A

United States Patent [19]

Morrison et al.

[11] Patent Number: 5,417,196

[45] Date of Patent: May 23, 1995

[54] AUTOMATIC BALL PROJECTION MACHINE

[75] Inventors: Howard Morrison, Riverwoods; Leonard Stubenfoll, Orland Park, both of Ill.

[73] Assignee: Breslow, Morrison, Terzian & Associates, Inc., Chicago, Ill.

[21] Appl. No.: 60,426

[22] Filed: May 7, 1993

[51] Int. Cl.[6] ..... A63B 65/12

[52] U.S. Cl. ..... 124/6

[58] Field of Search ..... 124/1, 6, 78

[56] References Cited

U.S. PATENT DOCUMENTS

| | | | |
|---|---|---|---|
| 1,211,738 | 1/1917 | Marty | 124/6 |
| 2,705,945 | 4/1955 | Cavalier | 124/6 |
| 3,306,613 | 2/1967 | Mainers | 124/6 X |
| 3,399,660 | 9/1968 | Swartout | 124/6 |
| 3,713,658 | 1/1973 | Cook | 124/1 X |
| 4,552,120 | 11/1985 | Nall et al. | 124/1 |
| 4,705,014 | 11/1987 | Kahelin | 124/1 |
| 4,883,272 | 11/1989 | Lay | 124/6 X |
| 5,107,820 | 4/1992 | Salansky | 124/78 |
| 5,125,653 | 6/1992 | Kovacs et al. | 124/78 X |

FOREIGN PATENT DOCUMENTS

| | | | |
|---|---|---|---|
| 4021282 | 10/1991 | Germany | 124/6 |

*Primary Examiner*—Eric K. Nicholson
*Assistant Examiner*—John A. Ricci
*Attorney, Agent, or Firm*—Malin, Haley, DiMaggio & Crosby

[57] ABSTRACT

An automatic ball projection machine comprising a housing section that encloses a receiving section, a chute section, an ejection section, and a power section, while supporting a catching section, wherein a plurality of balls are loaded into the housing section through an inlet aperture, delayed in the receiving section, engaged and propelled by the ejection section, and adjustably directed out the chute section through an outlet aperture at a force sufficient for hitting or catching. Balls are thrown back at the apparatus into the catching section, which entraps and guides the balls into the inlet aperture for recycling.

19 Claims, 7 Drawing Sheets

AUTOMATIC BALL PROJECTION MACHINE

BACKGROUND OF THE INVENTION

1. Field of the Invention

This invention relates generally to an apparatus for projecting a ball, and more particularly, to a ball pitching, throwing, and catching machine having a catching net, adjustable pitching speeds, and an adjustable ejection chute for practice in throwing, hitting, and fielding balls.

2. Description of the Prior Art

Baseball has long been one of America's most popular sports and since its inception, it has gradually caught worldwide attention and acceptance. For instance, baseball has been received in Canada, Japan, Taiwan, South America, and Europe, and is now included as an Olympic sport. Moreover, while the sport of baseball has spanned other continents, it has become an integral part of American family life from little league teams to professional organizations.

Children first learn about baseball from visiting ballparks, watching television, and participating in organized leagues. It fosters dreams of future recognition in almost every youngster, and for those kids fortunate enough to acquire the requisite skills, baseball has provided an avenue for obtaining scholarships in higher education, escaping the streets, and reaching prosperity. Among the skills necessary to succeed in baseball are catching ground balls, line drives, and pop flies, batting, and throwing. The more batting, throwing, and catching techniques are practiced, the more developed a child's skills become. Hence, the sooner a child is given the opportunity to develop and perfect these baseball skills, the greater the young athlete's chances of succeeding in the sport as an adolescent and an adult.

Pitching machines are among the most widely used devices for training, however, they generally are only available to older children, adolescents, and adults. Furthermore, existing pitching means merely concentrate on developing a player's batting skills rather than the tripartite skills of throwing, catching, and hitting. Since these techniques take years to develop, a device which affords children the opportunity to practice these skills early in life would be extremely useful and beneficial. Therefore, there exists a need for a machine capable of training young children to field grounders, line drives, and pop flies, as well as hitting pitched balls, and to throw at a designated target.

SUMMARY OF THE INVENTION

The present invention contemplates a ball projection machine which catches and ejects balls for practice in the baseball skills of throwing, catching, and hitting, and which further ejects balls for developing the tennis skills of swinging and placing the ball. The machine is comprised of a housing section which encloses a receiving section, a chute section, an ejection section, and a power section, while supporting a catching section.

The housing section provides an enclosure having an inlet aperture and an outlet aperture. The inlet aperture accommodates the receipt of balls by the receiving section while the outlet aperture facilitates ejection of the same.

The receiving section comprises a curved tubular channel and a cam arrangement both internally disposed within the housing section. The tubular channel is concentric with the inlet aperture at its top end and in registry with the ejection section at its bottom end. A multiplicity of balls are automatically fed through the machine where they are moved from the receiving section into the ejection section and propelled through the outlet aperture. The cam arrangement delays movement of these balls to allow a player to get into position while the ejection section regains momentum between ejecting balls. This feature of the invention is novel, efficient, and effective in design wherein it utilizes an eccentric wheel or cam, a ratchet, a plurality of gears, and a cam motor to accomplish the timing function.

Another unique aspect of the present invention is the chute section which is formed from a curved tubular chute having curved top and bottom panels and two parabolic sidewalls. Together, the panels and sidewalls form a parabolic enclosure that guides the passage of balls. A cylindrical sleeve spans the width of the parabolic enclosure at its upper end where it mates with an axle to support and adjust the chute ejection angle. Moreover, the sleeve and axle combination in conjunction with the parabolic enclosure provide a novel design that facilitates adjustable angles of ejection for projecting grounders, line drives, and pop flies.

The instant invention also introduces a novel ejection system which rests within the confines of the chute section. While conventional pitching machines utilize a lever or arm to propel balls, the present ejection system incorporates a flywheel driven by a motor, a drive wheel, and a pulley scheme. To compel propulsion, the drive wheel and drive motor communicate with the flywheel by means of a belt. The belt is attached to a pulley and the drive wheel to effectuate rotation of the flywheel while the drive motor is running. The rotation of the flywheel forces the ejection of the balls as they enter the tubular chute and engage the flywheel. Accordingly, ejection speed is dictated by the flywheel velocity.

The entire system is energized by the power section which comprises a plurality of DC batteries connected in series to provide a single source of power to the drive motor and the cam motor. A variable resistor is also placed in series with the battery pack and the motor section load to vary the speed of the system. Additionally, the variable resistor provides a switch which alternates between an open and closed position by turning a knob located on the housing. The flywheel and cam mechanism speeds are varied by this knob to facilitate adjustable pitching speeds.

The catching section affords another unique feature of the instant invention. It comprises a net, a ball basket, a guide plate, and a support frame disposed along the lateral edge of said net. Together, the net, ball basket, frame, and guide plate mount to the housing section and circumscribe the inlet aperture to facilitate automatic feed of trapped balls. The net provides a target for aiming balls, and upon engagement with the net, the ball gravitates toward the ball basket and the inlet aperture for receipt by the receiving section.

To utilize the instant invention, the catching section is first mounted to the housing section as aforementioned. Balls are then loaded into the ball basket where they are automatically fed into the inlet aperture. The ejection trajectory is next adjusted by rotating the chute section about its axis. To deliver grounders, the chute is angled downward, such that the outlet aperture is in its lowest position. Pitches ranging from line drives, to pop flies, to lobs in tennis are produced by increasing the height of the outlet aperture. When the chute section is rotated beyond vertical in the rearward direction, the balls are vertically ejected, caught by the net, and recycled through the machine on a continuous basis until hit. This produces the baseball batting challenge called "fungo" hitting. Once the chute is adjusted, the machine may be powered and the player may get into position to either catch or hit the ball.

Time is provided to get into position wherein the cam provides a delay before ejecting the balls. Once a ball is ejected from the machine, the player either swings at the pitched ball for batting practice, or for practicing either forehand or backhand swings, or catches the line drive, pop fly, or grounder. The user practices either throwing or placing the ball by aiming the ball into the catching net. After the net catches the ball, it gravitates back into the inlet aperture for another cycle.

In accordance with the present invention, it is an object hereof to provide an automatic ball projection machine that ejects balls in a way that allows young children to practice batting, throwing, and catching grounders, line drives, and pop flies, and to practice forehand or backhand swings.

An additional object of the instant invention is to provide a machine that affords children the opportunity to practice catching, hitting, and throwing skills early in life to increase their chances of excelling in baseball.

Still an additional object of the instant invention is to provide an automatic ball projection machine that is simple yet efficient and effective in design.

Another object of the instant invention is to provide an automatic ball projection machine that may be marketed in the toy industry.

In accordance with these and other objects which will be apparent hereinafter, the instant invention will now become described with particular reference to the accompanying drawings.

DESCRIPTION OF THE PREFERRED EMBODIMENTS

Figure 1:
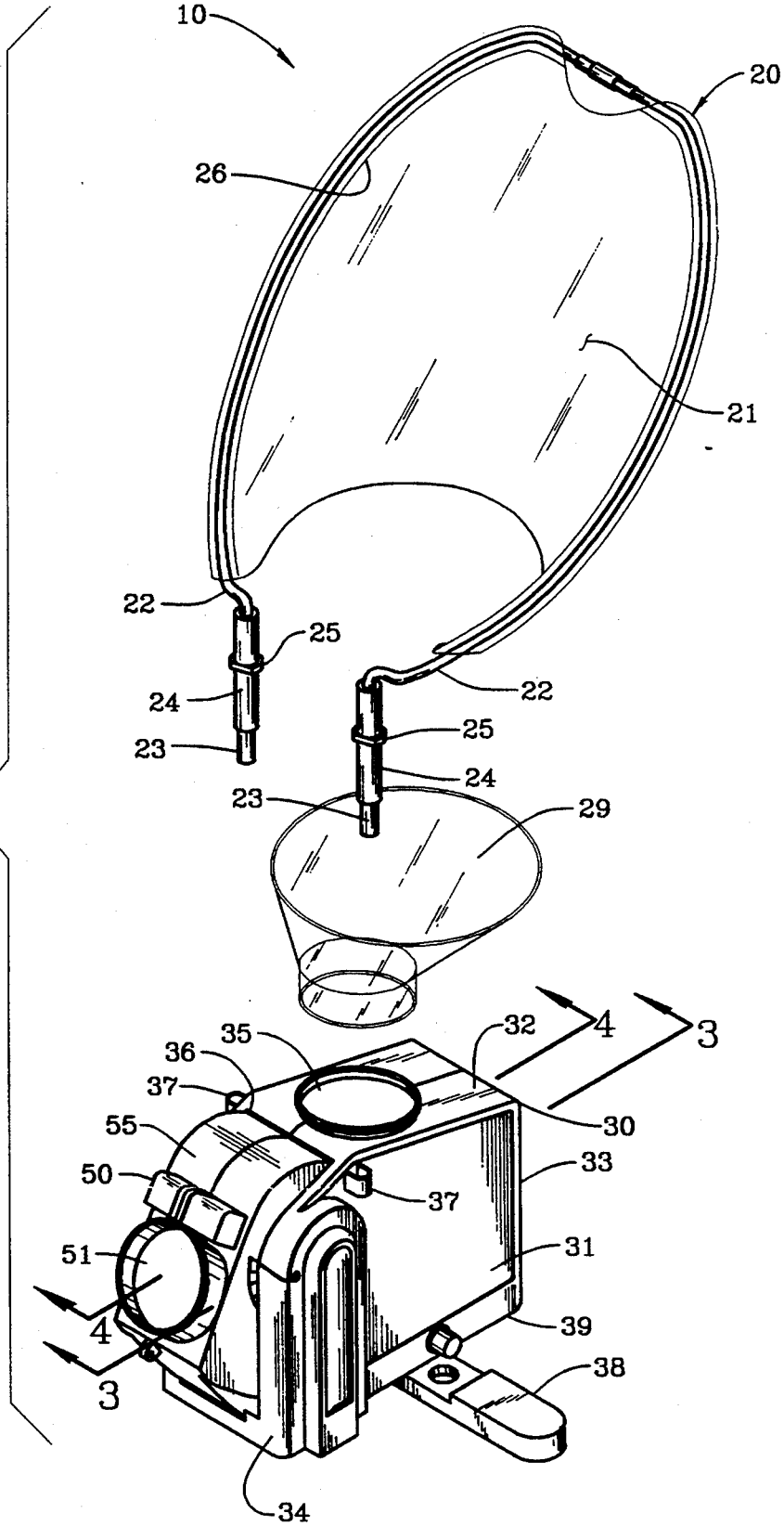
FIG. 1 is a perspective view of the preferred embodiment of the instant invention with the net, ball basket, and guide plate exploded.

With reference to FIGS. 1–2 and 6–7, there is depicted an automatic ball projection machine generally characterized by the reference numeral 10, comprising a housing section 30 which encloses a receiving section 40, a chute section 50, an ejection section 60, a power section 70, and a catching section 20. In this embodiment, housing section 30 is comprised of a bottom surface 39 integrally constructed with upstanding sidewalls 31, having a top panel 32 which protrudes from the sidewalls 31 at the upper end of housing 30 to provide the housing enclosure 30, as depicted in FIG. 1. The top panel 32 has an inlet aperture 35 for balls to enter and an outlet aperture 36 that cuts from the top panel 32 down the front sidewall 34 to facilitate adjustment of the chute section. Disposed on the outside of the sidewalls 31 are mounting sleeves 37 for connecting and supporting the catching section 20. Housing section 30 further comprises stand 38 for support and balance of said housing section 30.

In the preferred embodiment as seen in FIG. 1, catching section 20 comprises net 21, ball basket 29, and a support frame 22 disposed along the lateral edge of net 21. Frame 22 protrudes from net 21 and comprises mounting ends 23, rods 24, and frame stop 25. Rods 24 are mounted to mounting ends 23, wherein mounting ends 23 extend below rods 24. Ball basket 29 is attached to housing section 30 by inserting an end of basket 29 into inlet aperture 35. Catching section 20 is mounted to housing section 30 by inserting mounting ends 23 into mounting sleeves 37 on sidewalls 31. When catching section 20 is attached to housing section 30, net 21 provides a target for throwing or placing balls 11 and once caught, the balls 11 gravitate toward ball basket 29 and the inlet aperture 35 for receipt by receiving section 40.

Figure 6:
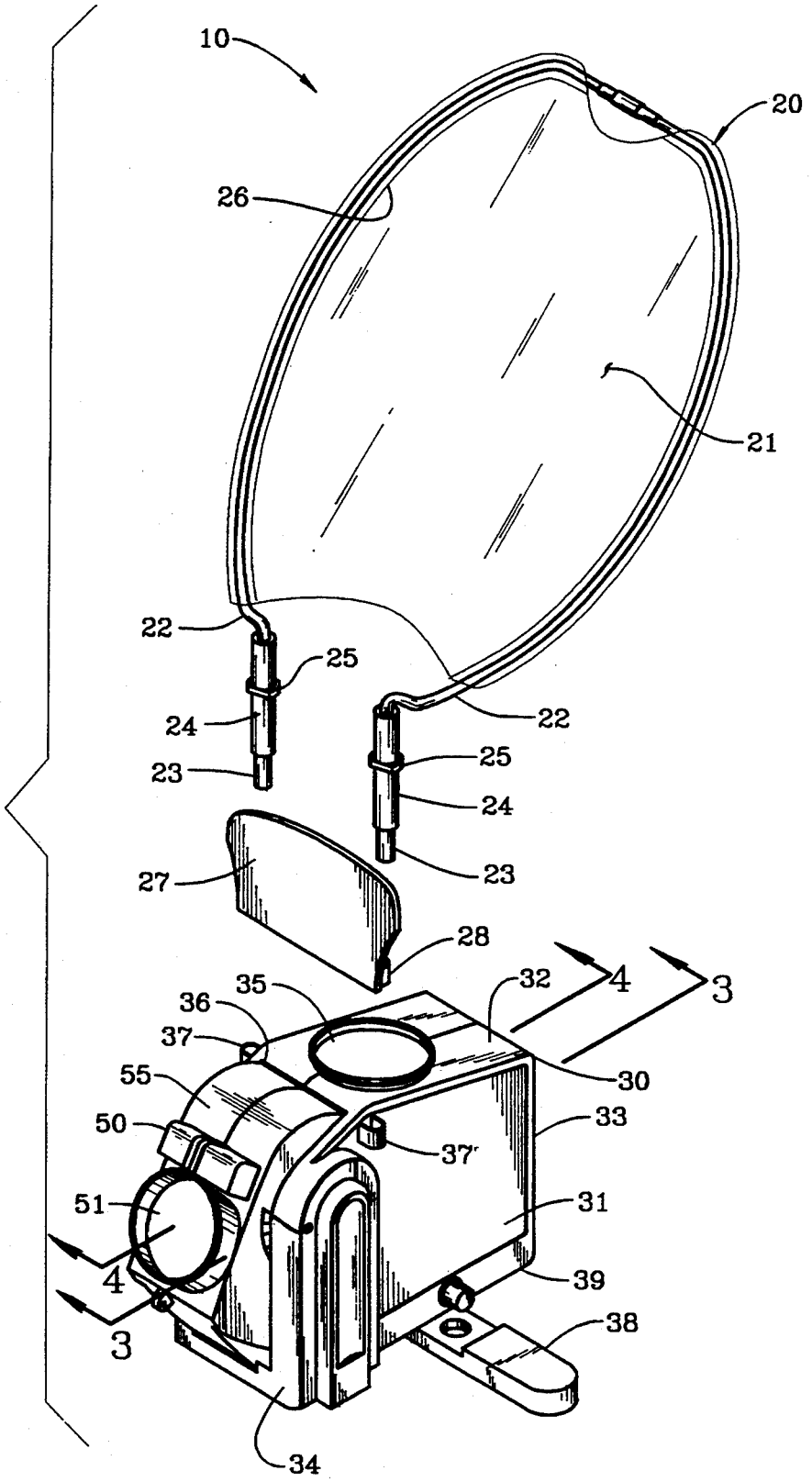
FIG. 6 is an exploded view of an alternate embodiment of the instant invention.
Figure 7:
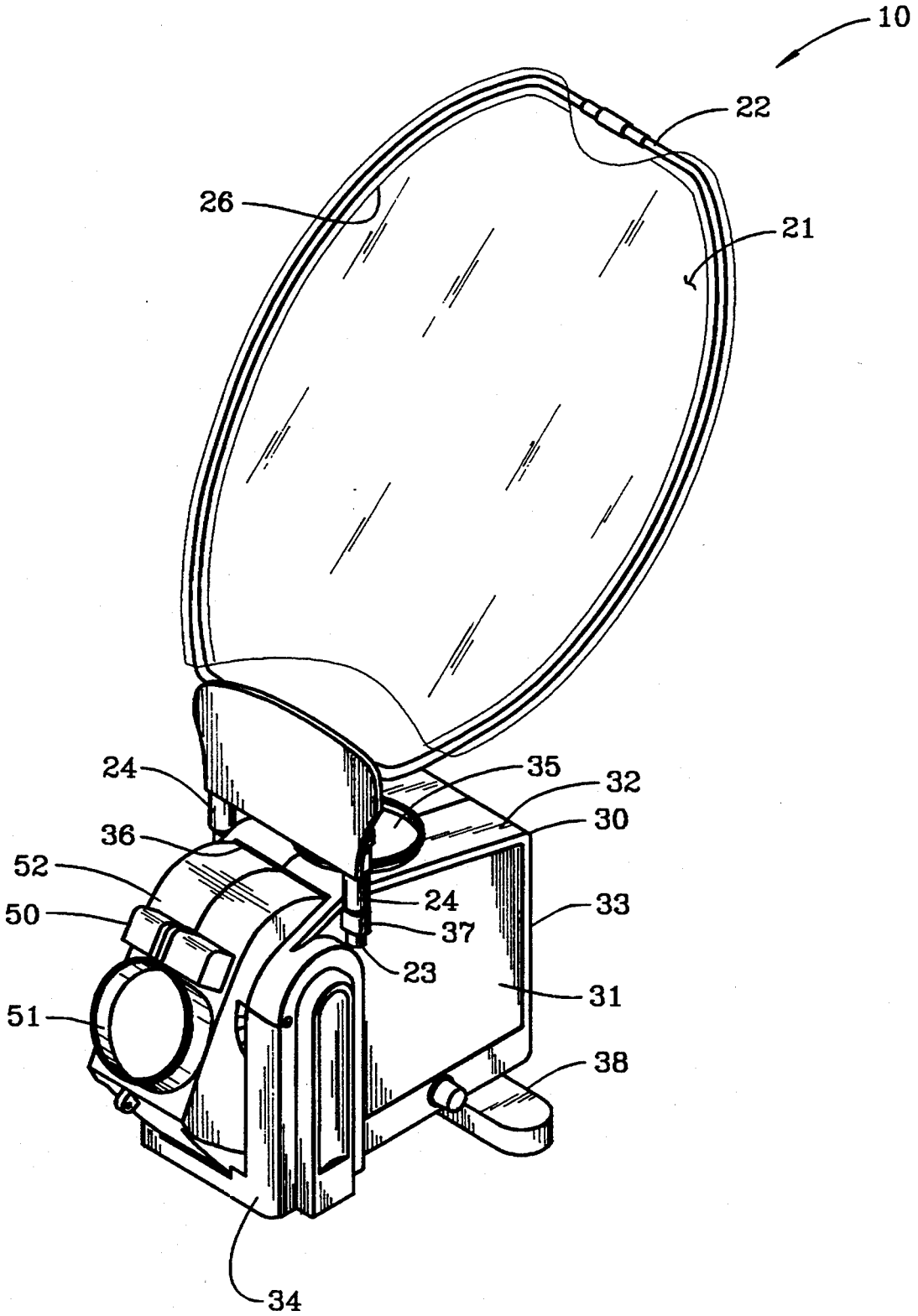
FIG. 7 is a perspective view illustrating the alternate embodiment shown in FIG. 6 fully assembled.

In an alternate embodiment, catching section 20, as seen in FIG. 6, comprises a net 21, a guide plate 27, and a support frame 22 disposed along the lateral edge of net 21. The guide plate 27 is mounted to support frame 22 by mating rods 24 with guide sleeves 28. With guide plate 27 attached, FIG. 7 shows catching section 20 mounted to housing section 30 by inserting mounting ends 23 into mounting sleeves 37 on sidewalls 31. The frame support stops 25 rest on guide sleeves 28 when guide plate 27 is mounted to catching section 20 and catching section 20 is mounted to housing section 30. When catching section 20 is attached to housing section 30, net 21 and guide plate 27 circumscribe inlet aperture 35. Net 21 provides a target for throwing of placing balls 11 and once caught, the balls 11 gravitate toward the inlet aperture 35 for receipt by receiving station 40.

Figure 3:
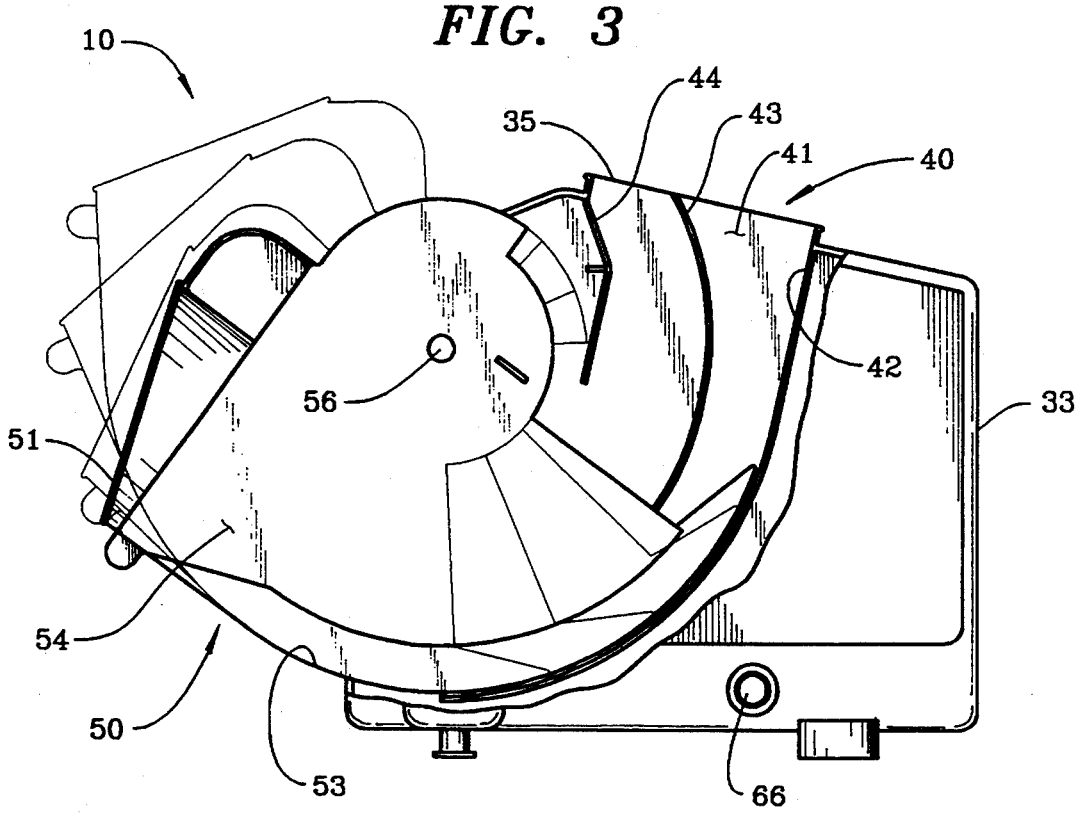
FIG. 3 is a cross sectional side view taken of the housing at sectional line "3—3" in FIG. 1, illustrating the interior housing section of the instant invention.
Figure 4:
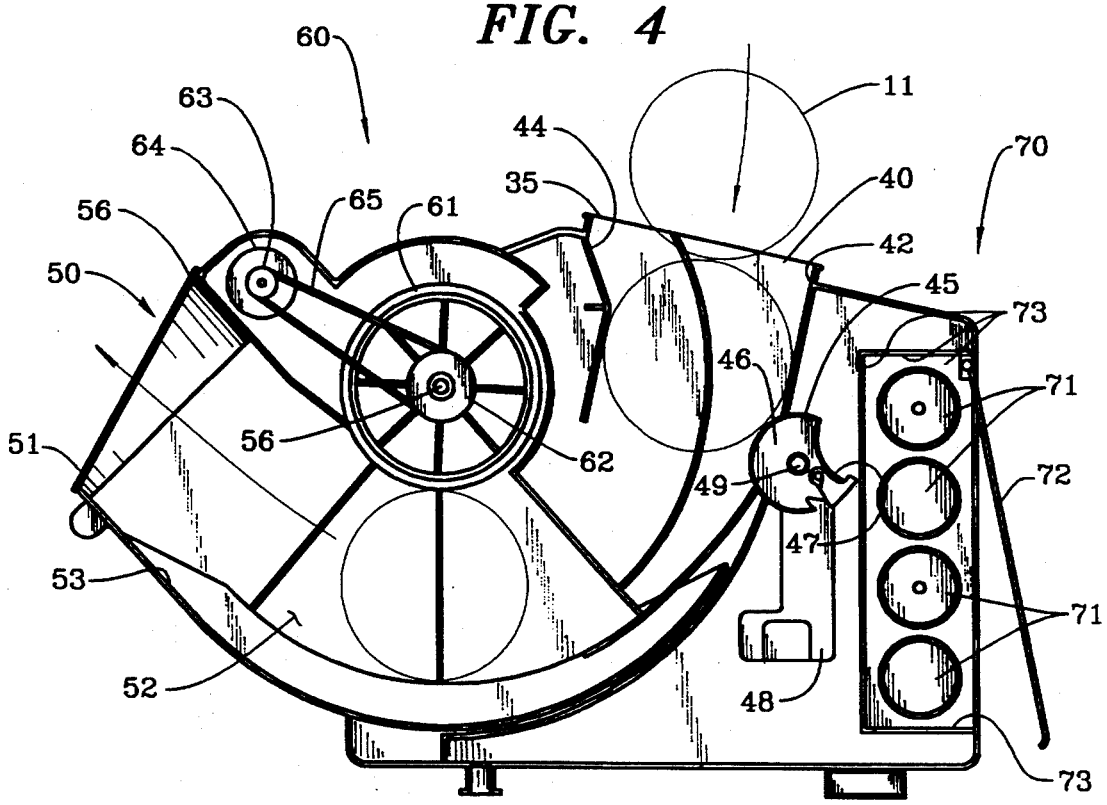
FIG. 4 is a cross sectional side view taken of the housing and chute section at sectional line "4—4" in FIG. 1, illustrating the receiving section, power section, and ejection section of the instant invention.

Receiving section 40, as seen in FIGS. 3 and 4, comprises curved tubular channel 41 and cam arrangement 45 which are internally disposed within housing section 30. Tubular channel 41 is comprised of guide strips 43 which are integrally combined with inner sidewalls 31, curved front panel 44, and curved back panel 42. The upper peripheral rim of tubular channel 41 defines the inlet aperture 35. Curved front panel 44, guide strip 43, and curved back panel 42 pend downward into housing enclosure 30 to form guide cylinder 41 therein. Tubular channel 41 is co-radially aligned with inlet aperture 35 at one end and with chute section 50 at the other end to form one continuous path for balls 11 to travel from inlet aperture 35 to ejection aperture 51.

Cam arrangement 45 comprises an eccentric wheel or cam 46, a ratchet 47, a plurality of gears (not shown), and cam motor 82 (FIG. 5) disposed in the transmission compartment 48. The cam motor 82 contains a shaft 49, which is connected to the plurality of gears. The cam motor 82 drives the gears, which communicate with the cam 46 to rotate the cam 46 and maintain its velocity ratios with respect to the cam motor 82. Ratchet system 47 is connected to cam 46 and maintains rotation of cam 46 in one direction. Cam arrangement 45 is mounted within housing section 30 such that cam 46 partially penetrates tubular channel 41 as depicted in FIG. 4. The movement of balls entering the receiving section 41 are delayed by the penetrating cam 46. Passage of the balls through tubular channel 41 is allowed upon rotation of eccentric wheel 46, wherein an adequate opening is provided at the "instance of least penetration" into tubular channel 41 by cam 46, that is, when the curved section of the cam 46 faces the channel 41.

Figure 2:
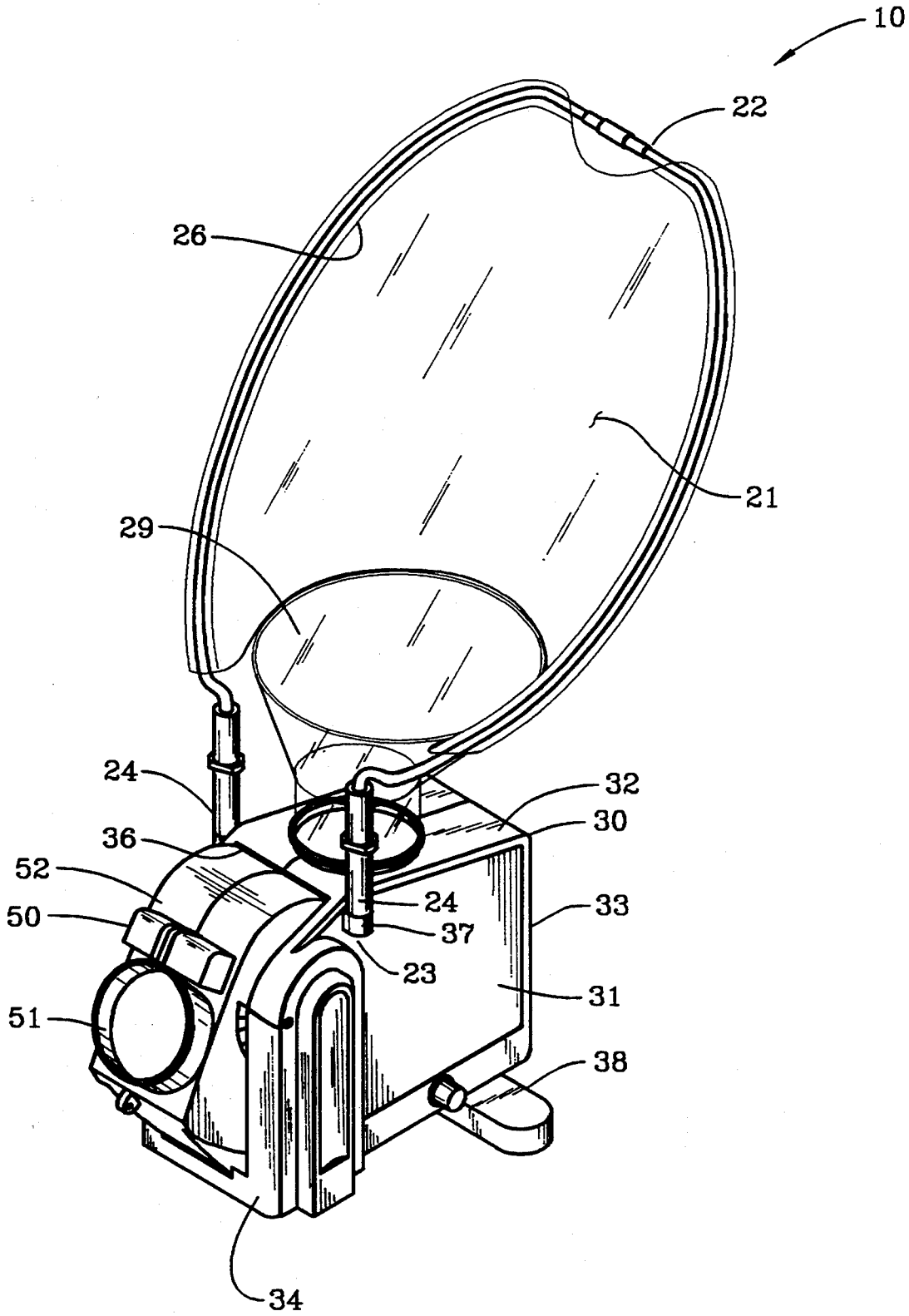
FIG. 2 is a perspective view of the preferred embodiment of the instant invention, illustrating attachment of the net, ball basket, and guide plate.

The chute section 50 comprises a curved tubular chute 52 concentric with the receiving section 40 and pivotally disposed within said housing section 30, having a curved bottom panel 53 with two parabolic sidewalls 54 extending upwardly therefrom (see FIG. 3). A curved top panel 55, as depicted in FIGS. 1 and 2, is integrally combined with the top parabolic curved portions of the parabolic sidewalls 54 to connect the same. Extending across the upper end of the chute section 50 is a cylindrical sleeve (not shown) containing an axle 56 which is connected to inner sidewalls 31. Axle 56 mates with the chute sleeve, allowing the tubular chute 41 to rotate thereabout to adjustably direct the chute section 50 for varying angles of ejection. Chute section 50 is further supported by curved back panel 42, wherein chute 50 runs along back panel 42 during adjustments. Together, tubular channel 41 and tubular chute 52 provide a common passageway for the movement of balls in and out of housing section 30.

Figure 5:
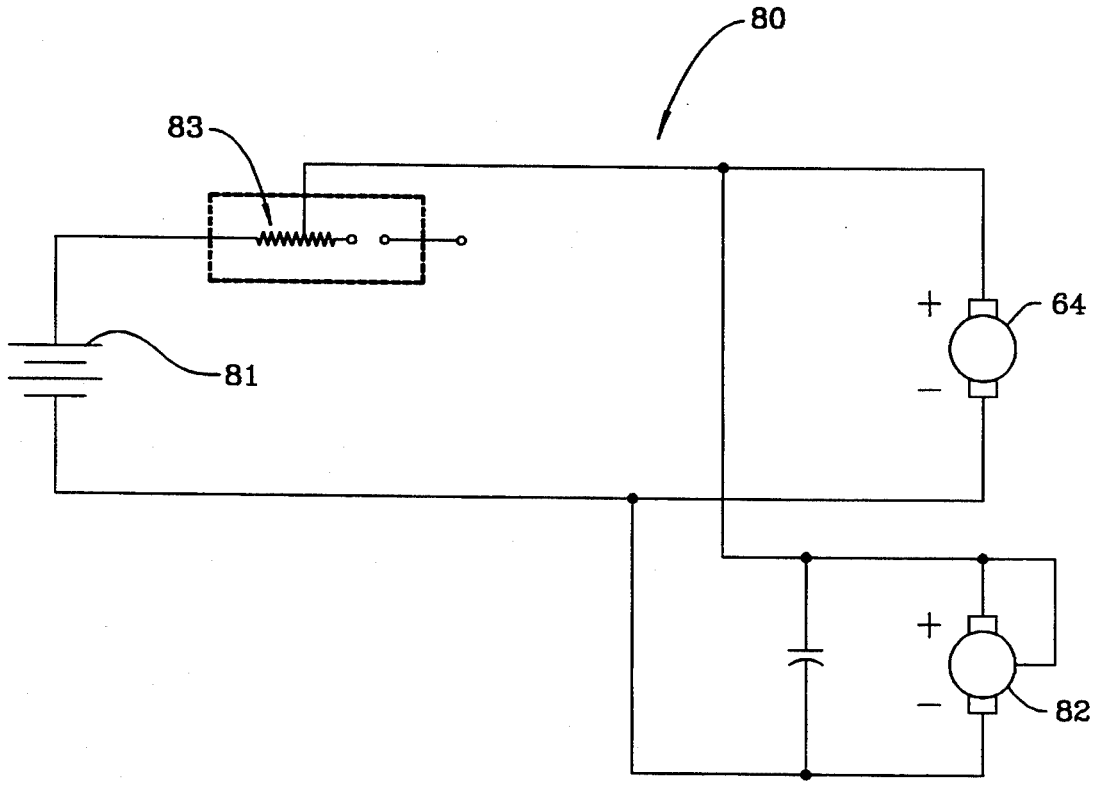
FIG. 5 is a circuit diagram of the power section of the instant invention.

Ejection section 60 comprises a drive wheel 63, a drive motor 64, a flywheel 61, and a drive belt 65, all of which are contained in the chute section 50. Flywheel 61 and pulley 62 are integrally combined with sleeve 56. Drive wheel 63 is connected to drive motor 64 to convert electrical energy to mechanical energy and together are offset from and in communication with flywheel 61 by means of drive belt 65 as depicted in FIG. 4. The belt 65 attaches to the pulley 62 and the drive wheel 64 such that mechanical energy is transferred to provide rotation of the flywheel 61 when the drive motor 64 propels the drive wheel 63. A variable resistor 83 is coupled to the drive motor 64, as shown in FIG. 5, for adjusting its speed, which in turn varies the speed of flywheel 61. The variable resistor 83 is adjusted by means of knob 66 located on sidewall 31 outside the housing section to facilitate convenient adjustment of flywheel 61 speed.

Battery compartment 70 and power section 80 are also contained within housing section 30. Battery compartment 70 comprises positive contacts, ground contacts (not shown), sidewalls 73, and hinged door 72. The contacts herein described couple the batteries 71 of power section 80 to the rest of the circuit. Power section 80 comprises a plurality of DC batteries 71 in series which operate together to provide a single battery source 81 to power the drive motor 64 and the cam motor 82. See FIG. 5. Power section 80 also contains a variable resistor 83 which controls the speed of drive motor 64 and cam motor 82 by varying the resistance of the variable resistor 83 which in turn varies the power to drive motor 64 and cam motor 82. A decrease in resistance increases the cam motor and drive motor speeds while an increase in resistance decreases motor speeds. The variable resistor 83 is connected in series with battery 81 and the motor section, that is, the drive motor 64 and cam motor 82 load. The variable resistor 83 also provides a switch which moves between open and closed positions to remove and provide power, respectively.

To utilize the instant invention, in the preferred embodiment, the catching section 20 is mounted to housing section 30 as aforementioned. The balls are loaded into the housing section 30 by inserting them into ball basket 29 where they fall by gravity into the inlet aperture 35 where they are received by the receiving section 40. The angle of ejection should next be adjusted for proper trajectory, based upon intended use by rotating the chute section 50 to its appropriate angle about an axle 56 within the housing. The lowest positioning of chute section 50 will provide grounders, central positioning will provide line drives, and higher angled positioning of the chute section 50 will accommodate pop flies. Chute section 50 may also be rotated slightly beyond vertical towards the rear for continuous recycling of the balls 11 until hit. Once adjusting chute section 50, power may be applied by rotating knob 66 which closes the switch on variable resistor 83 to apply power to the drive motor 64 and cam motor 82. The cam arrangement 45 will delay the ejection of the balls in order to allow the player to get into position for either catching or hitting the ejected balls. Upon proper rotation of the cam arrangement 45, a ball will seek entry into the tubular chute 52 where it will be ejected by the ejection section 60. Once a ball is ejected from the pitching machine 10, a player may either aim and hit the ball or catch it as required. Time again will be allotted for aiming and throwing the ball into the catching net 20 by the cam mechanism 45 which will delay movement of the next ball. Together, the automatic pitching machine 10 allows a user to practice hitting or catching a ball and pitching it into the target of the catching net 21. Upon completion of use, the machine 10 is turned off by merely rotating knob 66 in the reverse direction, thus opening the switch of variable resistor 83 and removing power.

Figure 8:
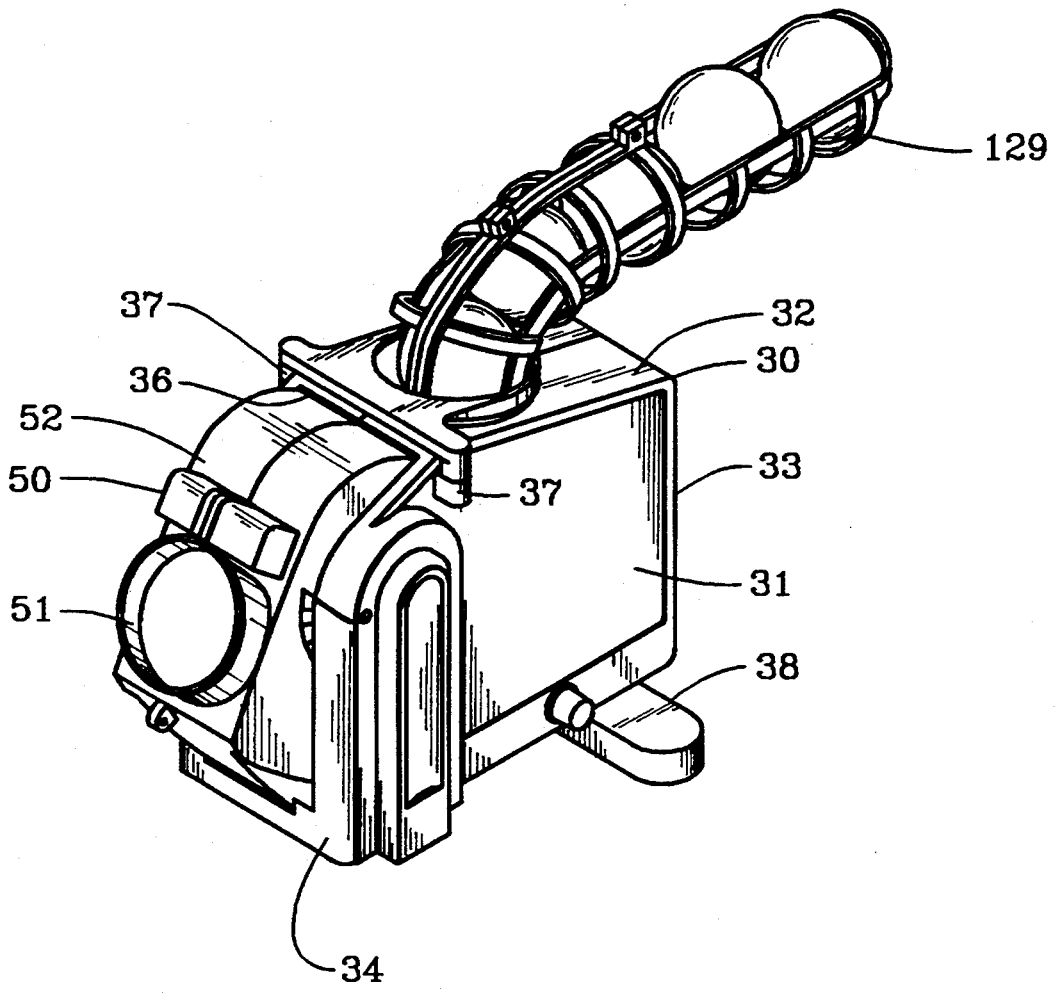
FIG. 8 is a perspective view illustrating a third embodiment of the present invention.

In the alternate embodiment shown in FIG. 8, the balls 11 are loaded into the housing section 30 by inserting them into ball basket 129, where they fall by gravity into the inlet aperture, where they are received by the receiving section. As described above, the angle of ejection should next to adjusted for proper trajectory based upon intended use, whether fielding or catching an ejected ball, swinging at a pitched ball for batting practice, or for practicing forehand or backhand swings.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for projecting a ball used in a sporting event, comprising:

a housing for providing an enclosure, said housing having an inlet aperture and an outlet aperture;

a receiving means disposed within said housing for receiving a ball directed through said inlet aperture; and an ejecting means disposed in said housing and operatively associated with said receiving means for propelling said ball through said outlet aperture at a force sufficient to direct said ball away from said aperture, said ejecting means including a means for directing the ball by adjusting the angle at which said ball is propelled from said outlet aperture, said directing means rotatably mounted within said housing, said directing means comprising a tubular chute rotatably mounted to said ejecting means for adjusting said tubular chute, said tubular chute partially projecting through said outlet aperture.

2. An apparatus according to claim 1, wherein said receiving means further includes a means for delaying movement of a plurality of balls to said ejecting means after entry through said inlet aperture, said delaying means partially disposed in said receiving means.

3. An apparatus according to claim 2, wherein said delay means comprises a cam arrangement.

4. An apparatus according to claim 1, wherein said apparatus further includes a means for catching balls, said catching means releasably attached to said housing over said inlet aperture for trapping airborne balls thrown at said apparatus and guiding said balls into said inlet aperture.

5. An apparatus according to claim 1, wherein said ejecting means further includes a variable speed motor driving said ejecting means.

6. An apparatus according to claim 1, further including a means for adjusting speed in electrical communication with said delaying means and said ejecting means, said speed adjusting means for simultaneously varying the delay time before said ball is guided to said ejecting means and the speed at which said ball is propelled through said outlet aperture.

7. An apparatus for projecting a ball used in a sporting event, comprising:

a housing for providing an enclosure, said housing having an inlet aperture and an outlet aperture;

a receiving means disposed within said housing for receiving a ball directed through said inlet aperture, said receiving means having a means for delaying movement of a plurality of balls after entry into said inlet aperture, said delaying means partially disposed in said receiving means;

an ejecting means disposed in said housing and operatively associated with said receiving means, said ejecting means for receiving a ball from said receiving means and propelling said ball through said outlet aperture, said delaying means delaying movement of balls to said ejecting means to control time between ejections;

a catching means releasably mounted to said housing over said inlet aperture for trapping an airborne ball thrown at said apparatus and for guiding said ball into said inlet aperture, said catching means comprising a net and further including a guide means, said guide means simultaneously engaging said net and said inlet aperture so as to provide a passageway for guiding the ball from said net into said inlet aperture; and an angle adjustment means in registry with said ejecting means and partially disposed within said housing and protruding outwardly therefrom, said angle adjustment means for varying the angle at which said ball is propelled through said outlet aperture.

8. An apparatus according to claim 7, wherein said housing means comprises:

a bottom surface having side walls extending upwardly, terminating at an upper peripheral edge to provide side enclosures;

a top panel protruding inwardly from said upper peripheral edge to enclose the top of said housing, said top panel further including portions defining said inlet aperture for receiving balls into said receiving means, and said top panel and said sidewalls further including portions defining said outlet aperture where balls are propelled through.

9. An apparatus according to claim 7, wherein said receiving means comprises a curved tubular channel defined interiorly by said housing, said curved tubular channel having a top end and a bottom end, said top end concentric with said inlet aperture, and said bottom end in registry with said ejecting means to provide one continuous path for ball travel from said inlet aperture to said ejection means.

10. An apparatus according to claim 7, wherein said ejecting means comprises:

a flywheel;

a pulley connected to said flywheel; and a driving means in communication with said pulley for spinning said flywheel so that a ball is propelled forward through said outlet aperture when engaging said flywheel.

11. An apparatus according to claim 10, wherein said driving means comprises:

a variable speed motor;

a means for powering said variable speed motor;

a drive wheel connected to said motor for converting electric energy to mechanical energy; and a belt mounted to said drive wheel and to said pulley to transfer the energy from said drive wheel to said pulley so as to rotate said flywheel.

12. An apparatus according to claim 7, wherein said catching means further includes a support frame disposed along the lateral edge of said net for supporting said net, said support frame having mounting ends protruding from said net for mounting said net to said housing.

13. An apparatus according to claim 7, wherein said guide means comprises a plate facing said net to provide a passageway for ball, said plate and said net together circumscribing said inlet aperture so as to guide the ball from said net into said inlet aperture.

14. An apparatus according to claim 7, wherein said guide means comprises a substantially conically shaped ball basket.

15. An apparatus according to claim 7, wherein said angle adjustment means comprises a curved tubular chute rotatably mounted within said housing in registry with said ejection means and partially protruding from said outlet aperture so as to provide an adjustable channel for propulsion out said outlet aperture, said curved tubular chute further being concentric with said receiving means so as to provide one continuous passageway for balls to travel from said receiving means through said outlet aperture.

16. An apparatus according to claim 7, further including a means for adjusting speed in electrical communication with said delaying means and said ejecting means, said speed adjusting means for simultaneously varying the delay time before said ball is guided to said ejecting means and the speed at which said ball is propelled through said outlet aperture.

17. An apparatus according to claim 7, wherein said delaying means comprises a cam arrangement partially disposed in said receiving means for delaying movement of a plurality of balls into said ejecting means.

18. An apparatus for projecting a ball used in a sporting event comprising:

a housing for providing an enclosure, said housing having an inlet aperture and an outlet aperture;

a receiving means disposed within said housing for receiving a ball directed through said inlet aperture, said receiving means comprising a curved tubular channel defined interiorly by said housing, said channel having a top end and a bottom end, said top end concentric with said inlet aperture;

an ejecting means operatively associated with said receiving means for propelling said ball through said outlet aperture, said bottom end in registry with said ejecting means to provide one continuous path for ball travel from said inlet aperture to said ejecting means, said ejecting means comprising a flywheel, a pulley connected to said flywheel, and a driving means in communication with said pulley for spinning said flywheel so that the ball is propelled forward through said outlet aperture when engaging said flywheel;

means for delaying movement of a plurality of balls to said ejecting means after entry through said inlet aperture to control time between ejections, said delaying means comprising a cam arrangement partially disposed in said tubular channel and attached interiorly to said housing;

a speed adjustment means in electrical communication with said ejecting means and said delaying means for simultaneously varying the amount of time said balls are delayed and the speed at which said balls are propelled through said outlet aperture;

a curved tubular chute rotatably mounted within said housing in registry with said flywheel and protruding said outlet aperture so as to provide an adjustable channel for adjusting angle of propulsion out said outlet aperture, said curved tubular chute further being concentric with said receiving means so as to provide one continuous passageway for balls to travel from said receiving means to said ejecting means out said outlet aperture; and a catching means releasably mounted to said housing over said inlet aperture for trapping an airborne ball thrown at said apparatus, further including a means for guiding balls into said inlet aperture, said guide means engaging said inlet aperture so as to provide a passageway for guiding the ball from said net into said inlet aperture.

19. An apparatus according to claim 18, wherein said driving means comprises a variable speed electric motor, a drive wheel coupled to said variable speed electric motor, wherein said variable speed electric motor spins said drive wheel, and a belt mounted to said drive wheel and said pulley such that when said motor spins said drive, said belt propels said flywheel.

* * * * *